US008113442B2

(12) United States Patent
Li et al.

(10) Patent No.: US 8,113,442 B2
(45) Date of Patent: Feb. 14, 2012

(54) HAND HELD SHOWER WITH A BUTTON SWITCHING MECHANISM FOR SWITCHING SPRAY PATTERNS

(75) Inventors: Renzhong Li, Xiamen (CN); Robert Zhou, Xiamen (CN)

(73) Assignees: Xiamen Solex High-Tech Industries Co., Ltd., Xiamen (CN); Robert Zhou, Xiamen (CN)

( * ) Notice: Subject to any disclaimer, the term of this patent is extended or adjusted under 35 U.S.C. 154(b) by 434 days.

(21) Appl. No.: 12/533,722

(22) Filed: Jul. 31, 2009

(65) Prior Publication Data

US 2011/0024516 A1 Feb. 3, 2011

(51) Int. Cl.

| | |
|---|---|
| ***B05B 17/04*** | (2006.01) |
| ***B05B 7/02*** | (2006.01) |
| ***B05B 1/30*** | (2006.01) |
| ***A62C 31/00*** | (2006.01) |
| ***A62C 37/20*** | (2006.01) |

(52) U.S. Cl. ..... 239/11; 239/443; 239/445; 239/526; 239/562; 239/581.1; 239/581.2

(58) Field of Classification Search ..... 239/11, 239/443, 444, 445, 446, 447, 525, 526, 538, 239/539, 540, 553, 553.3, 562, 581.1, 581.2, 239/582.1

See application file for complete search history.

(56) References Cited

U.S. PATENT DOCUMENTS

2010/0264237 A1* 10/2010 Engel ..... 239/443
2011/0226876 A1* 9/2011 Xu ..... 239/562

FOREIGN PATENT DOCUMENTS

CN 201026470 Y 2/2008

* cited by examiner

*Primary Examiner* — Len Tran
*Assistant Examiner* — Ryan Reis
(74) *Attorney, Agent, or Firm* — Rabin & Berdo, P.C.

(57) ABSTRACT

A hand held shower with a button switching mechanism for switching spray patterns disclosed in the present invention comprises a body, a button switching mechanism and a cover unit. The button switching mechanism comprises a seat, a disc, a lever, a button, a lower ratchet wheel sleeve and an upper wheel bar. Each time the button pressed, the disc will be rotated to a certain angle so that the outlet hole of the disc will align with the different inlets of seat. The inlets of the seat and the channels with different functions of the cover unit cooperate to switch the spray pattern. The spray pattern can be conveniently and accurately switched by pressing the button with one hand and with little effort.

11 Claims, 10 Drawing Sheets

HAND HELD SHOWER WITH A BUTTON SWITCHING MECHANISM FOR SWITCHING SPRAY PATTERNS

FIELD OF THE INVENTION

The present invention relates to a bath shower, more particularly, to a hand held shower with a button switching mechanism for switching spray patterns which is convenient in operation.

BACKGROUND OF THE INVENTION

Hand held shower is one of the widely used appliance in daily life such as in bath. Generally Traditional hand held shower comprises a body and a face cover, said body having a water passage way therein, the body can be divide into a handle and a head, the water passage way leads from the tail of the handle to the head, the handle is for holding by users, the face cover rotatably mounted to the head, when the cover rotate relative to the head, the outlet direction and the outlet gap between the cover and the head will be changed so as to form different spray patterns. When the user want to change the spray pattern, it is necessary to hold the handle in one hand and rotate the cover with the other hand, which is inconvenient and awkward. For these and many other reasons, it would be desirable to provide a hand held shower which can be operated by one hand. Such as an utility model CN200720006708 which discloses a shower switched by a handle pushing button comprises a body and a handle, wherein, a water diverting slide plate and a water diverting body with more than two functional holes are arranged in the body; the water diverting slide plate is provided with a through hole which is communicated with the functional holes to realize the functional switch; the handle is provided with a pushing button in a slide way; a connecting bar mechanism is arranged inside the body, and one end of the connecting bar mechanism is connected with the pushing button while the other end is connected with the water separating slide plate, the switching of spray pattern can be accomplished by pushing the push button. However, the switching action of the spray device of these structure accomplished by pushing or pulling the button, thus the user must hold body tightly to formed an opposite force to push the button, the operation is not very convenient.

SUMMARY OF THE INVENTION

Accordingly, the primary object of the present invention is to provide a hand held shower with a button switching mechanism for switching spray patterns, and the switching of spray patterns is accomplished by pressing the button, this shower having the characteristic of switching spray pattern by one hand, convenient operation, economy force and high operation location accuracy.

these and other objects of the present invention are achieved by providing a hand held shower with a button switching mechanism for switching spray patterns, wherein the shower comprising a body, a button switching mechanism and a cover unit, said button switching mechanism mounted in the front chamber of said body, a water passage way leading from the front chamber to the end of said body, said cover unit fixed to said button switching mechanism, said cover unit having several different channel with different spray pattern respectively, and said button switching mechanism having several inlets corresponding to the channels in said cover unit.

said button switching mechanism comprising a seat, a disc, a lever, a button, a lower ratchet wheel sleeve and an upper wheel bar, said seat fixed to said body and having an inlet channel communicated with said inlet, said disc movably mounted in said inlet channel, said disc having outlets which corresponding to the inlets of the inlet channel in rotation, the first end of the lever abut against the supporting portion of said seat and the lever urged against the seat via a return spring, the second end of said lever fixed to said button; the upper portion of said disc having a rotation shaft which pass through the lever, the lower ratchet wheel sleeve in turn and fixed to the upper ratchet wheel, the upper portion of the upper ratchet abut against said body. The lower portion of said upper ratchet wheel bar having several inclined grooves, and the upper portion of said lower ratchet wheel sleeve formed several upstanding first protrusions which having a first inclined surface corresponding to the inclined grooves of the upper ratchet wheel bar; said lever having a central channel for receiving said lower ratchet sleeve, the vertical direction of said central channel having rooms allowing for the movement of the lower ratchet wheel sleeve, the circular edge of the lower ratchet wheel sleeve having symmetrical second protrusions, and the bottom of said second protrusion formed second inclined surface, the bottom of central channel of lever formed a third inclined surface corresponding to the second inclined surface of the lower ratchet wheel sleeve, the upper portion of the central channel wall having a limiting surface corresponding to the top of the second protrusion.

A return spring disposed between said lower ratchet wheel sleeve and said lever, one end of said return spring fixed to the lever and the other end fixed to the lower ratchet wheel sleeve along the rotation direction of the lower ratchet wheel sleeve.

The upper portion of said rotation shaft is a flat shaft, and the upper ratchet bar has a flat hole, said flat shaft of rotation shaft match to the flat hole of said upper ratchet wheel bar.

The upper portion of the inlet channel of said seat has a lid, said disc movably mounted between the bottom of inlet channel and the lid, the shaft of said disc passing through the lid from bottom.

Said inlet hole disposed in the bottom of inlet channel, and a sealing ring installed in the inlet hole.

The upper portion of said shaft having a pressure spring which urge the bottom of said disc abut against the bottom of inlet channel, said pressure spring arranged between the upper portion of said shat and the front wall of body.

the hand held shower with a button switching mechanism for switching spray patterns of the present invention consisted of a body, a button switching mechanism and a cover unit, and said button switching mechanism comprising a seat, a disc, a lever, a button, a lower ratchet wheel sleeve and an upper wheel bar, by the linkage between the button and the lever and the cooperation between the lever and the lower ratchet wheel sleeve, the lower ratchet wheel sleeve and the upper wheel bar, the upper wheel bar and the disc, each time the button pressed, the disc will be rotated to a certain angle so that the outlet hole of the disc will align with the different inlets of seat. Then by the cooperation of the inlets of the seat and the channel with different function of the cover unit, thus the switching of different spray pattern will be accomplished. The switching of the spray pattern is by press, which can be accomplished by one hand, in operation, the user just only need to grip to press the button, and the reposition of the button can be accomplished by the return spring which is convenient and economy; Because the lever cooperated with the lower ratchet wheel sleeve by the cooperation between the second inclined surface of the second protrusion and the third inclined surface of the lever and by the cooperation between the top of the second protrusion of the lower ratchet wheel sleeve and the limit surface of the lever, the lower ratchet wheel sleeve and the upper ratchet wheel bar cooperated by the inclined grooves of the upper ratchet wheel bar and the first inclined surface of the first protrusion of the lower ratchet wheel sleeve, thus the shower has high operation location accuracy.

A preferred embodiment of the invention is shown in the attached drawings wherein:

PREFERRED EMBODIMENT OF THE INVENTION

Figure 1:
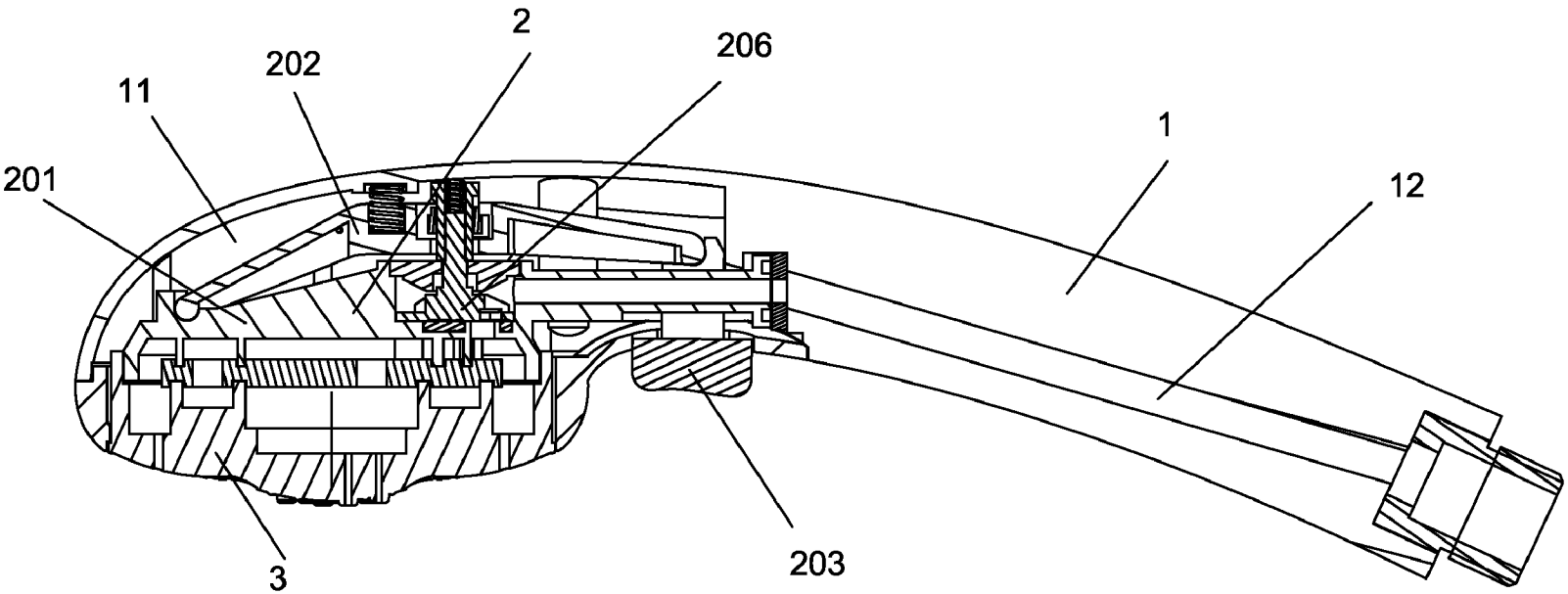
FIG. 1 is a front view of the present invention.
Figure 2:
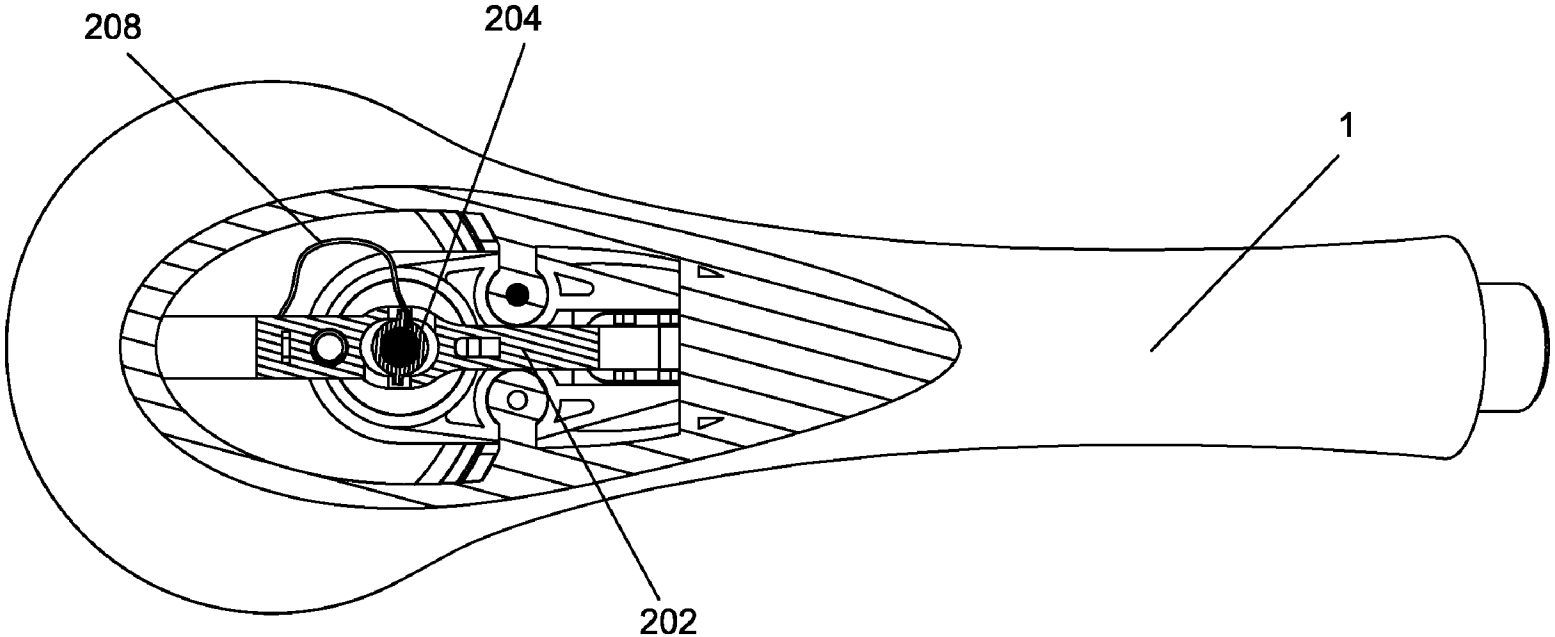
FIG. 2 is a top view of the present invention.
Figure 3:
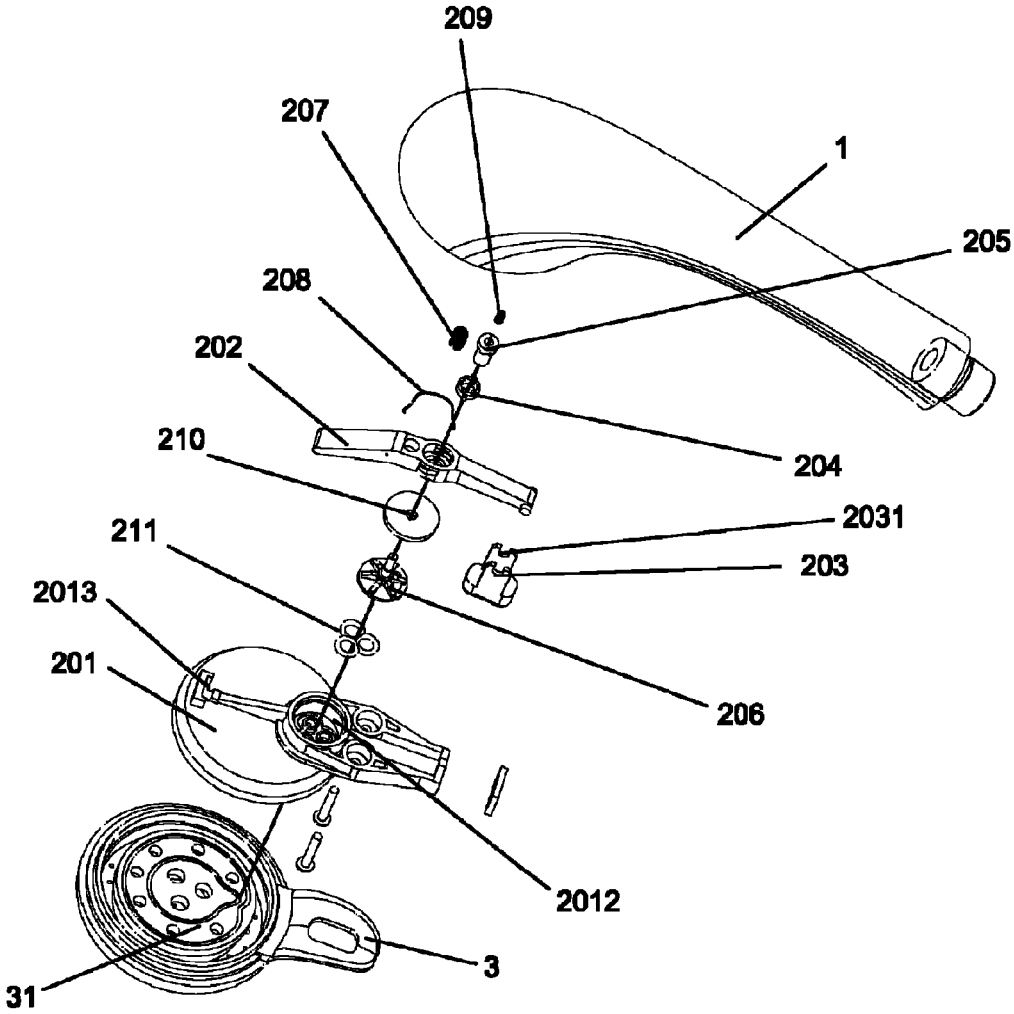
FIG. 3 is an exploded view of the present invention.
Figure 4:
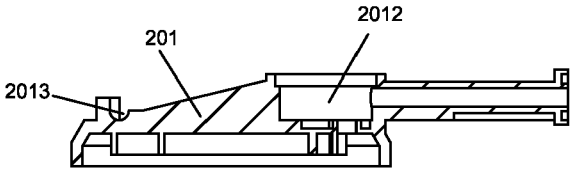
FIG. 4 is a sectional view of the seat of the present invention.

Referring to FIG. 1 to FIG. 14, the shower with a button switching mechanism for switching spray patterns of the present invention comprises a body 1, a button switching mechanism 2 and a cover unit 3, said button switching mechanism 2 mounted in the front chamber 11 of the body 1, a water passage way 12 leads from the front chamber 11 to the end of said body, said cover unit 3 fixed to said button switching mechanism 2, said cover unit 3 having several different channel 31 with different spray pattern respectively, and said button switching mechanism 2 having several inlets 2011 corresponding to the channels in said cover unit.

said button switching mechanism comprising a seat 201, a disc 206, a lever 202, a button 203, a lower ratchet wheel sleeve 204 and an upper wheel bar 205, said seat 201 fixed to said body 1 and an inlet 2011 of the button switching mechanism 2 disposed in the seat 201, the seat 201 further having an inlet channel 2012 communicated with said inlet 2011, said disc 206 movably mounted in said inlet channel 2012, said disc 206 having outlets 2061 which can cooperate with different inlets 2011 of the inlet channel 2012 in rotation, the disc has one outlet 2061 in this embodiment. The first end of the lever 202 abut against the supporting portion 2013 of said seat 201, and the lever 202 urged against the seat 201 via a return spring 207, the second end of said lever 202 fixed to said button 203; the upper portion of said disc 206 having a rotation shaft 2062 which pass through the lever 202, the lower ratchet wheel sleeve 204 in turn and fixed to the upper ratchet wheel bar 205, the upper portion of the upper ratchet bar 205 abut against said body 1. The lower portion of said upper ratchet wheel bar 205 having several inclined grooves 2051, and the upper portion of said lower ratchet wheel sleeve 204 formed several upstanding first protrusions 2041 which having a first inclined surface 2044 corresponding to the inclined grooves 2051 of the upper ratchet wheel bar 205 respectively; said lever 202 having a central channel 2027 for receiving said lower ratchet sleeve, the vertical direction of said central channel 2027 having rooms allowing for the movement of the lower ratchet wheel sleeve 204, the circular edge of the lower ratchet wheel sleeve 204 having symmetrical second protrusions 2042, the bottom of said second protrusion 2042 formed second inclined surface 2045, the bottom of central channel of lever 202 formed a third inclined surface 2021 which match with the second inclined surface 2045 of the lower ratchet wheel sleeve, the upper portion of the wall of the central channel of the lever 202 formed a limit surface 2026 which match with the top of the second protrusion 2042.

Herein:

A clamping spring 208 disposed between said lower ratchet wheel sleeve 204 and the lever 202, one end of said clamping spring 208 fixed to the lever 202 and the other end fixed to the lower ratchet wheel sleeve 204 along the rotation direction of the lower ratchet wheel sleeve. The lever 202 formed a slot 2023 for fixing the clamping spring 208, and the lower ratchet wheel sleeve 204 formed a slot 2043 for fixing the clamping spring 208 also.

The upper portion of said rotation shaft 2062 is a flat shaft, and the upper ratchet bar 205 has a corresponding flat hole 2052, said flat shaft of rotation shaft 2062 match to the flat hole 2052 of said upper ratchet wheel bar.

The upper portion of the inlet channel 2012 of said seat has a lid 210, said disc 206 movably mounted between the bottom of inlet channel 2012 and the lid 210, the shaft 2062 of said disc pass through the lid 210 from bottom.

Said inlet hole 2011 disposed in the bottom of inlet channel 2012, and a sealing ring 211 installed in the inlet hole 2011.

The upper portion of said shaft having a pressure spring 209 which urge the bottom of said disc abut against the bottom of inlet channel 2012, said pressure spring 209 arranged between the upper portion of said shaft 2062 and the front wall of body 1.

The first end of lever 202 formed a supporting shaft 2025 which abut against the supporting portion 2013 of the seat, said supporting portion 2013 of the seat is a groove.

The second end of lever 202 has a pin 2022, the top of the button 203 has a slot 2031 by which the button fixed to pin 2022 of the lever.

The top of the lever formed a groove 2024 for receiving the return spring, the return spring 207 disposed between the groove 2024 and the wall of the front channel of body 1.

The bottom of the seat 1 formed a disc shape so as to match to the channel of the cover unit.

Figure 5:
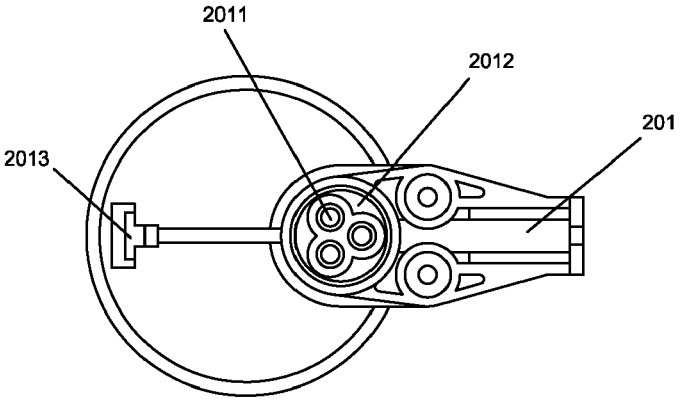
FIG. 5 is a top view of the seat of the present invention.
Figure 6:
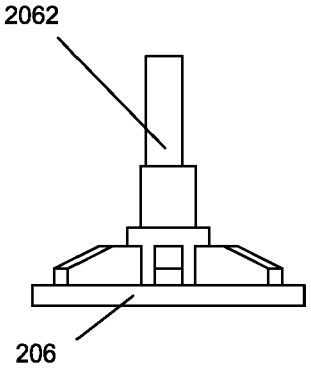
FIG. 6 is a front view of the disc of the present invention.
Figure 7:
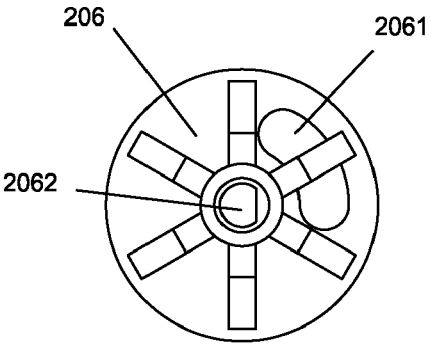
FIG. 7 is a top view of the disc of the present invention.
Figure 8:
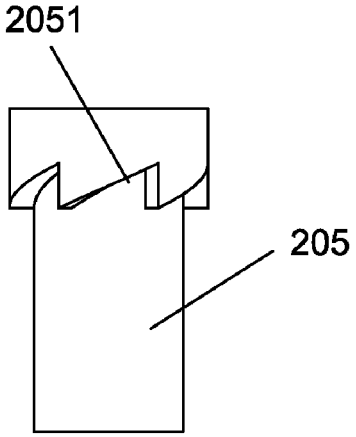
FIG. 8 is a front view of the upper ratchet wheel bar of the present invention.
Figure 10:
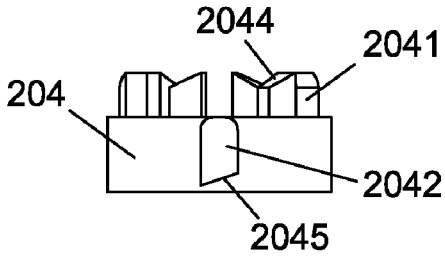
FIG. 10 is a front view of the lower ratchet wheel sleeve of the present invention.
Figure 11:
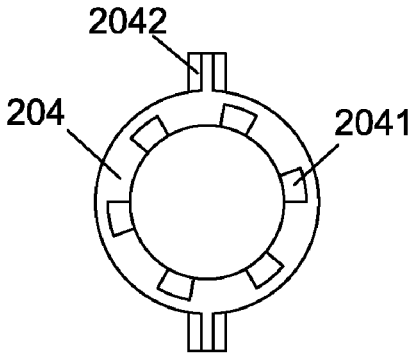
FIG. 11 is a top view of the lower ratchet wheel sleeve of the present invention.
Figure 9:
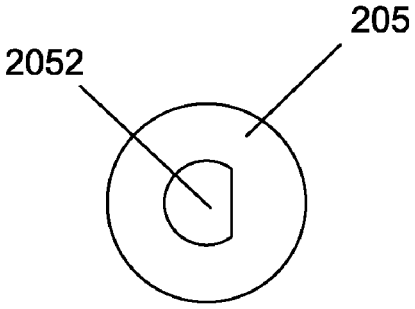
FIG. 9 is a top view of the upper ratchet wheel bar of the present invention.
Figure 12:
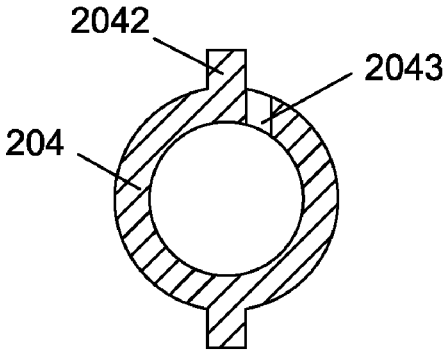
FIG. 12 is a top sectional view of the lower ratchet wheel sleeve of the present invention.
Figure 13:
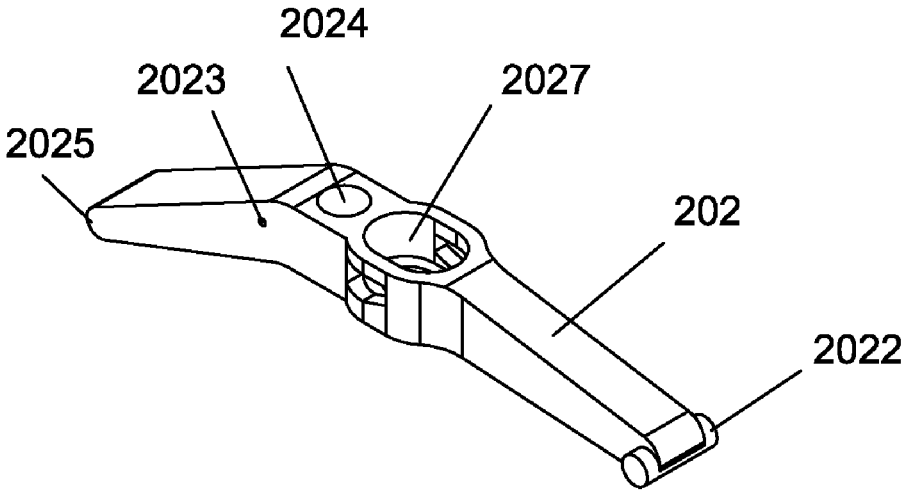
FIG. 13 is a perspective view of the lever.
Figure 14:
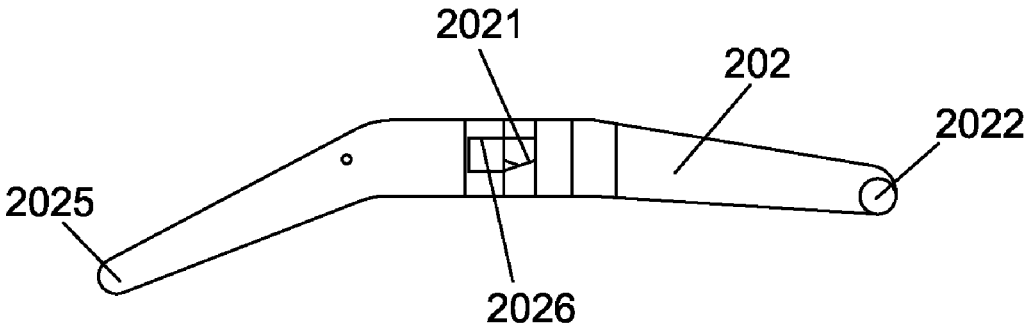
FIG. 14 is a front view of the lever.
Figure 15:
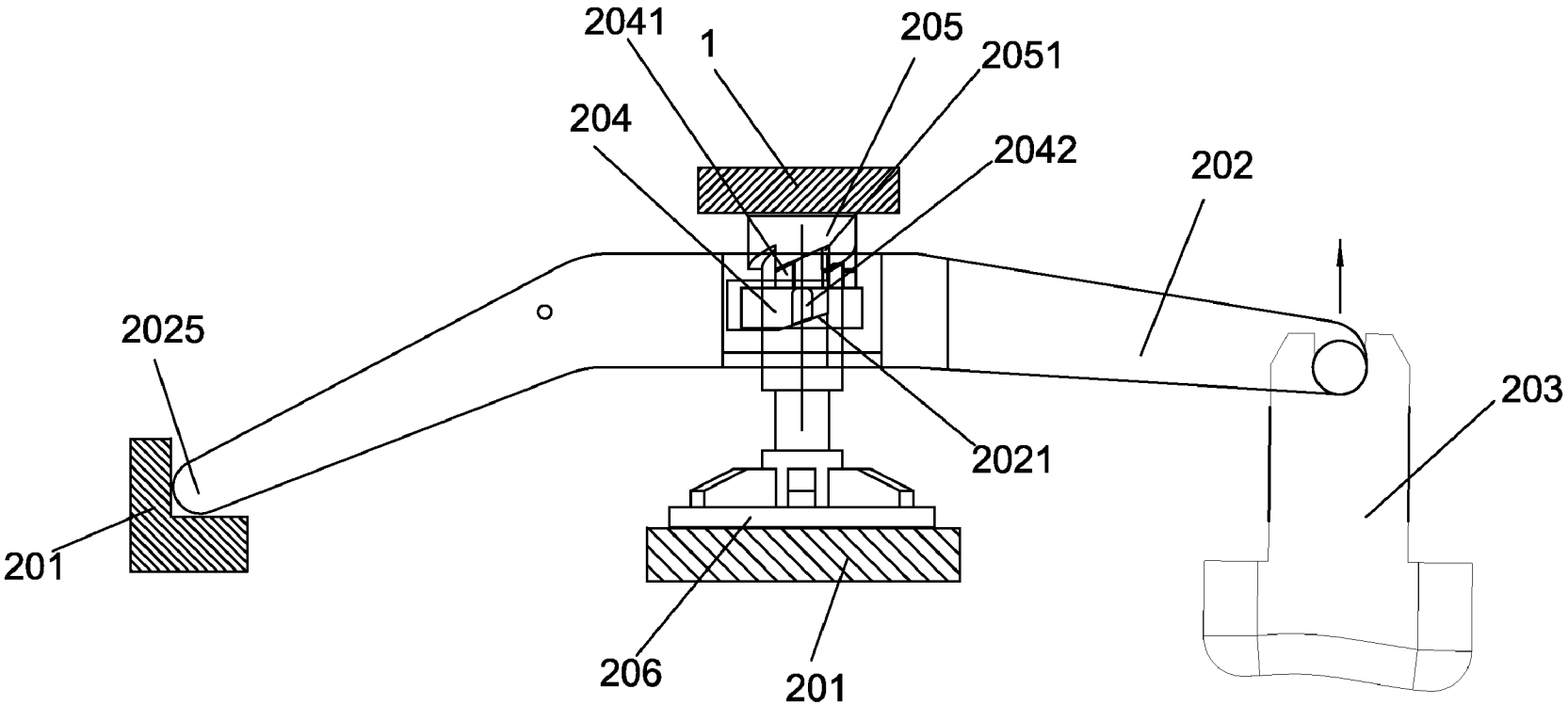
FIG. 15 is a partial view of the present invention (the button is in release status)
Figure 16:
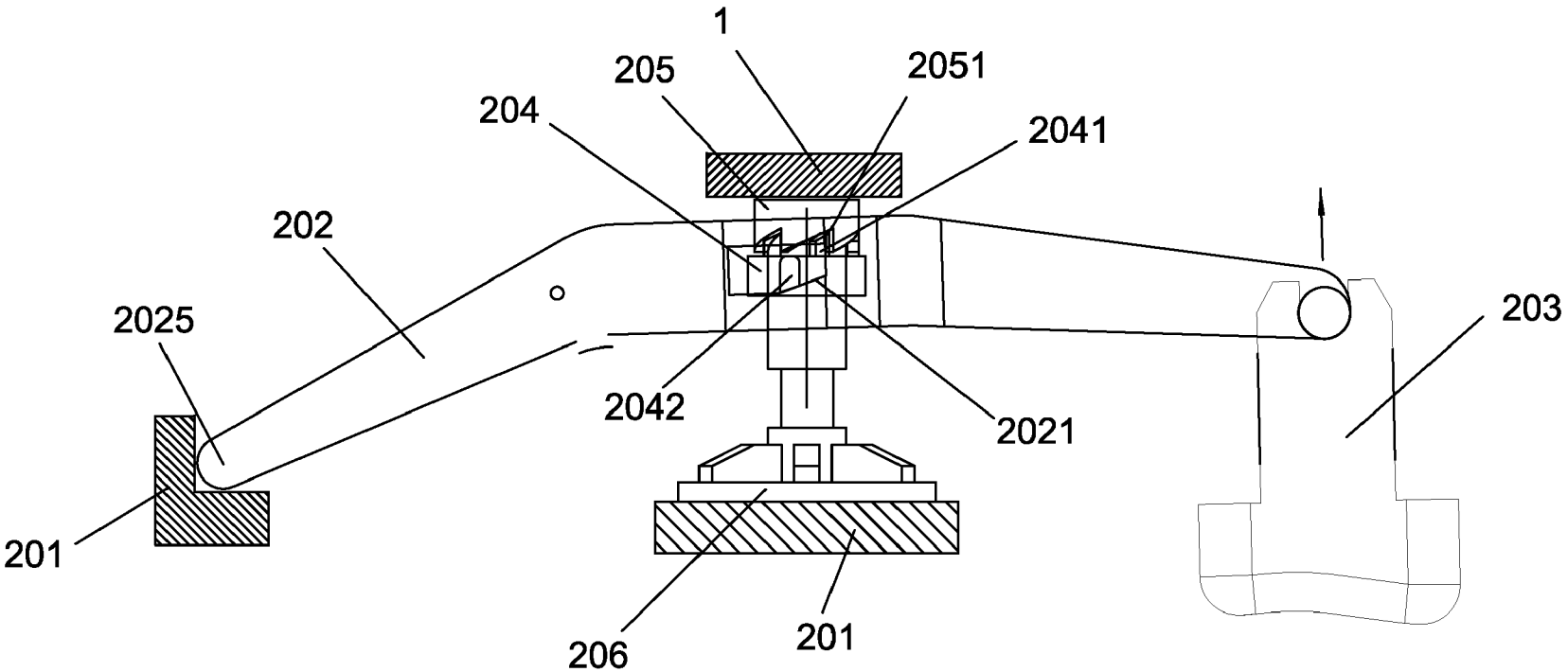
FIG. 16 is a partial view of the present invention (the button is in pressed status)
Figure 19:
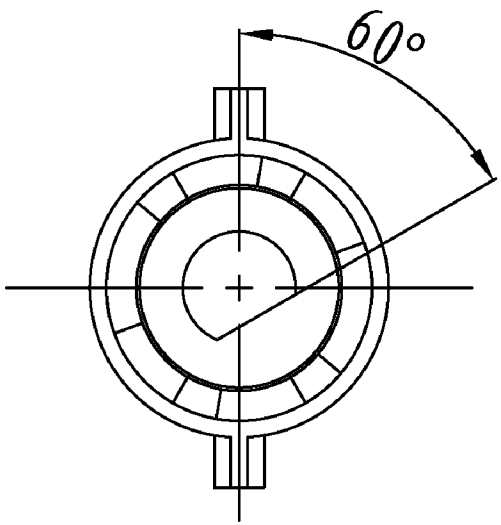
FIG. 19 illustrates the cooperation of the upper ratchet wheel bar and the lower ratchet wheel sleeve in position 3.
Figure 18:
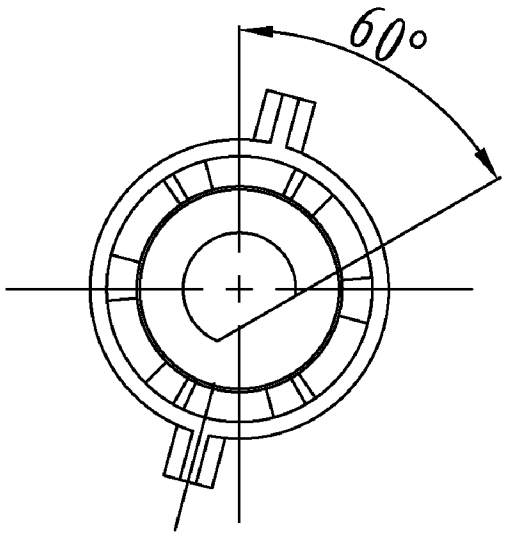
FIG. 18 illustrates the cooperation of the upper ratchet wheel bar and the lower ratchet wheel sleeve in position 2.
Figure 17:
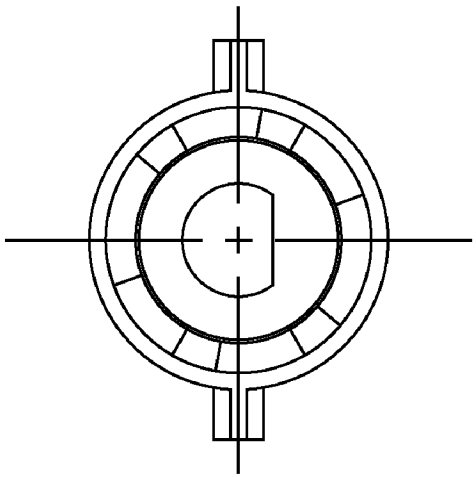
FIG. 17 illustrates the cooperation of the upper ratchet wheel bar and the lower ratchet wheel sleeve in position 1.

Referring to FIG. 15 to FIG. 22, the switching of spray pattern of the shower of present invention is accomplished by: press the button 203, the button 203 will move upwardly to drive the second end of the lever 202 to move upwardly, because the first end of the lever inserted into the groove 2013 of the seat and the spring 207 urged on the top of the lever 202, the button 203 drive the lever 202 to rotate relative to the supporting portion 2013 of the seat anti-clockwise via the pin 2022 of the lever (as shown in FIG. 5). When the lever 202 rotated, the bottom of the central channel 2027 of the lever (i.e. the third inclined surface 2021) is rise, because the third inclined surface 2021 of the lever is match with the bottom (i.e. the second inclined surface 2045) of the lower ratchet wheel sleeve and the third inclined surface 2021 of the lever abut against the second inclined surface 2045 of the lower ratchet wheel sleeve, the upward moving of the third surface 2021 of the lever drive the second protrusion 2042 move upwardly also, thus the lower ratchet wheel sleeve 204 move upwardly accordingly; after the lower ratchet wheel sleeve 204 move up, the first protrusion 2041 of the lower ratchet wheel sleeve will abut against the inclined groove 2051 of the upper ratchet wheel bar, i.e. the first inclined surface 2044 of the first protrusion of the lower ratchet wheel sleeve will abut against the inclined groove 2051 of the upper ratchet wheel bar, because the first inclined surface 2044 of the lower ratchet wheel sleeve match to the inclined groove 2051 of the upper ratchet wheel bar, thus the lower ratchet wheel sleeve 204 moving up will drive the upper ratchet wheel bar 205 to move upwardly. However, as the top of the upper ratchet wheel bar 205 abut against the body 1, the upper ratchet wheel bar 205 can not move up, urged by the first inclined surface 2044 of the lower ratchet wheel sleeve, the inclined groove 2051 of the upper ratchet wheel bar 205 slided along the first inclined surface 2044 of the lower ratchet wheel sleeve, thus the upper ratchet wheel bar 205 will rotate relative to the axis itself; because the shaft 2062 of the disc 206 fixed to the upper ratchet wheel bar 205, the rotation of the upper ratchet wheel bar 205 will make the disc 206 to rotate accordingly, when the first protrusion 2041 of the lower ratchet wheel sleeve 204 reach the bottom of the inclined groove 2051 of the upper ratchet wheel bar, the upper ratchet wheel bar 205 can not rotate relative to the lower ratchet wheel sleeve 204, herein the upper ratchet wheel bar has been rotated an angle $\phi 1$, and the disc 206 rotated an angle $\phi 1$ also; when the button 203 move up continue, because the second inclined surface 2045 of the second protrusion match to the bottom (i.e. the third inclined surface 2021) of the central channel of the lever, the second protrusion 2042 of the lower ratchet wheel sleeve will slide along the third inclined surface 2021 of the lever, thus both the lower ratchet wheel sleeve 204 and the upper ratchet wheel bar 205 will rotate relative to the shaft themselves with an angle $\phi 2$, because the upper ratchet wheel bar 205 rotated an angle $\phi 2$ more, the disc 206 will rotate an angle $\phi 2$ more also; therefore the disc 206 rotated an angle of $\phi 1+\phi 2$ by the action of the button 203, and the cooperation between the upper wheel bar and the lower ratchet wheel sleeve is from position 1 to position 2.

When the button 203 released by the user, the lever 202 will rotate relative to the pivot clockwise by the return spring 207, i.e. the lever 202 repositioned, the reposition of the lever 202 will make the upper wall (i.e. the limiting surface 2026) of the central channel of the lever move downwardly, because the limiting surface 2026 of the central channel of the lever match with the top of the second protrusion 2042, the limiting surface 2026 of the lever will drive the second protrusion 2042 of the lower ratchet wheel sleeve to move downwardly, i.e. the lever 202 will drive the lower ratchet wheel sleeve 204 to move downwardly, when the lower ratchet wheel sleeve 204 move to a position in which the top of the first protrusion 2041 leave from the inclined bottom of inclined groove 2051 of the upper ratchet wheel bar, the lower ratchet wheel sleeve 204 will rotate relative to the shaft itself to the beginning position by the return spring 208, the cooperation between the upper ratchet wheel bar and the lower ratchet wheel sleeve will from position 2 to position 3, thus a button switching period accomplished.

Figure 20:
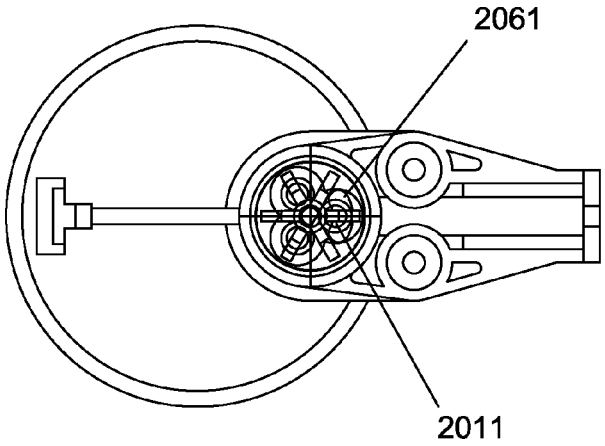
FIG. 20 illustrates the cooperation of the disc and the seat in position 1.
Figure 21:
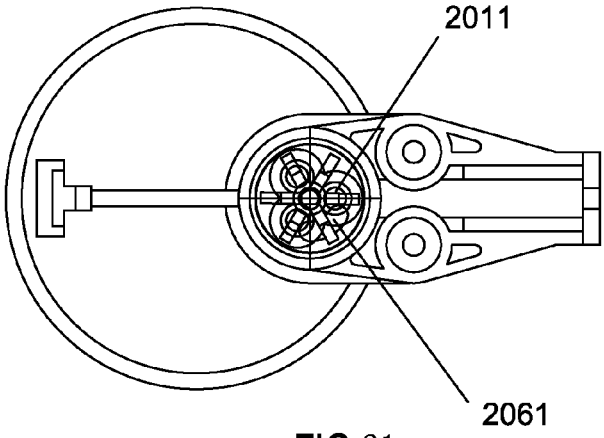
FIG. 21 illustrates the cooperation of the disc and the seat in position 2.
Figure 22:
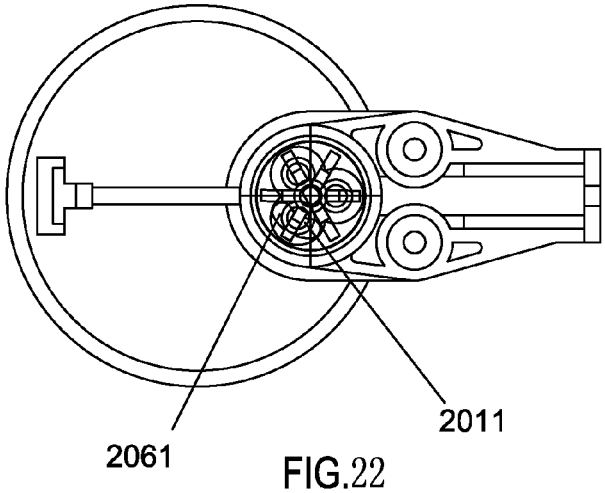
FIG. 22 illustrates the cooperation of the disc and the seat in position 3.

In a button switching period, the upper ratchet wheel bar 205 rotate an angle $\phi 1+\phi 2$, the disc 206 rotate an angle $\phi 1+\phi 2$ accordingly, with the rotation of the disc 206, the outlet 2061 of the disc can correspond to the different inlet 2011 to distribute the water into different channels having different spray patterns, thus achieve the switching of the different spray patterns, as shown in FIG. 20 to FIG. 22.

In this embodiment, the upper ratchet wheel bar 205 has six inclined grooves 2051, and the lower ratchet wheel sleeve has six first protrusion 2041, in a button switching period, the $\phi 1+\phi 2$ of the rotation of the upper wheel bar 205 is 60°, i.e. the disc 206 rotate 60°.

Those who are skilled in the art will readily perceive how to modify the invention. Therefore, the appended claims are to be construed to cover all equivalent structures which fall within the true scope and spirit of the invention.

What is claimed is:

1. A showerhead with a button switching mechanism for switching spray patterns comprising a body, a button switching mechanism and a cover unit, said button switching mechanism mounted in a front chamber of the body, a water passage way leading from the front chamber to the end of said body, said cover unit fixed to said button switching mechanism, said cover unit having several different channels with different spray patterns respectively, and said button switching mechanism having several inlets corresponding to the channels in said cover unit, wherein:

said button switching mechanism comprising a seat, a disc, a lever, a button, a lower ratchet wheel sleeve and an upper wheel bar, said seat fixed to said body and having an inlet channel communicated with said inlets, said disc movably mounted in said inlet channel, said disc having outlets which can cooperate with the different inlets of the inlet channel in rotation, a first end of the lever abuts against a supporting portion of said seat, and the lever urges against the seat via a return spring, a second end of said lever fixed to said button; the upper portion of said disc having a rotation shaft which passes through the lever, the lower ratchet wheel sleeve in turn is fixed to the upper ratchet wheel bar, an upper portion of the upper ratchet wheel bar abuts against said body, a lower portion of said upper ratchet wheel bar having several inclined grooves, and an upper portion of said lower ratchet wheel sleeve having several upstanding first protrusions which have a first inclined surface corresponding to the inclined grooves of the upper ratchet wheel bar respectively; said lever having a central channel for receiving said lower ratchet wheel sleeve, the vertical direction of said central channel having rooms allowing for the movement of the lower ratchet wheel sleeve, a circular edge of the lower ratchet wheel sleeve having symmetrical second protrusions, a bottom of said second protrusions having a second inclined surface, a bottom of the central channel of the lever having a third inclined surface which matches with the second inclined surface of the lower ratchet wheel sleeve, an upper portion of a wall of the central channel of the lever having a limit surface which matches with the top of the second protrusion.

2. The showerhead with a button switching mechanism for switching spray patterns according to claim 1, wherein a clamping spring is disposed between said lower ratchet wheel sleeve and the lever, one end of said clamping spring is fixed to the lever and the other end is fixed to the lower ratchet wheel sleeve along the rotation direction of the lower ratchet wheel sleeve.

3. The showerhead with a button switching mechanism for switching spray patterns according to claim 1, wherein the upper portion of said rotation shaft is a flat shaft, and the upper ratchet bar has a corresponding flat hole, said flat shaft of said rotation shaft matching the flat hole of said upper ratchet wheel bar.

4. The showerhead with a button switching mechanism for switching spray patterns according to claim 1, wherein the upper portion of the inlet channel of said seat has a lid, said disc being movably mounted between the bottom of the inlet channel and the lid, the shaft of said disc passing through the lid from the bottom.

5. The showerhead with a button switching mechanism for switching spray patterns according to claim 1, wherein said inlets are disposed in the bottom of the inlet channel, and a sealing ring is installed in the inlet hole.

6. The showerhead with a button switching mechanism for switching spray patterns according to claim 1, wherein the upper portion of said shaft has a pressure spring which urges the bottom of said disc to abut against the bottom of the inlet channel, said pressure spring is arranged between the upper portion of said shaft 2062 and the front wall of body.

7. The showerhead with a button switching mechanism for switching spray patterns according to claim 1, wherein the first end of the lever has a supporting shaft which abuts against the supporting portion of the seat, said supporting portion of the seat is a groove.

8. The showerhead with a button switching mechanism for switching spray patterns according to claim 1, wherein the second end of the lever has a pin, the top of the button has a slot by which the button is fixed to the pin of the lever.

9. The showerhead with a button switching mechanism for switching spray patterns according to claim 1, wherein the top of the lever forms a groove for receiving the return spring, the return spring is disposed between the groove and the wall of the front channel of the body.

10. The showerhead with a button switching mechanism for switching spray patterns according to claim 1, wherein the bottom of the seat has a disc shape so as to match to the channel of the cover unit.

11. A method of switching the spray pattern of a showerhead, wherein the showerhead comprises a body, a button switching mechanism and a cover unit, said button switching mechanism is mounted in a front chamber of the body, a water passage way leads from the front chamber to the end of said body, said cover unit is fixed to said button switching mechanism, said cover unit having several different channels with different spray patterns respectively, and said button switching mechanism having several inlets corresponding to the channels in said cover unit, said button switching mechanism comprising a seat, a disc, a lever, a button, a lower ratchet wheel sleeve and an upper wheel bar, by the linkage between the button and the lever and the cooperation between the lever and the lower ratchet wheel sleeve, the lower ratchet wheel sleeve and the upper wheel bar, the upper wheel bar and the disc, each time the button is pressed, the disc will be rotated to a certain angle so that an outlet hole of the disc will align with the different inlets of the seat, the cooperation of the inlets of the seat and the channels create a different function of the cover unit to accomplish the switching of different spray patterns.

* * * * *